United States Patent [19]

Jacobs

[11] 4,002,199

[45] Jan. 11, 1977

[54] REFRIGERATOR FOOD CONDITIONING APPLIANCE

[75] Inventor: James W. Jacobs, Dayton, Ohio

[73] Assignee: General Motors Corporation, Detroit, Mich.

[22] Filed: Nov. 10, 1975

[21] Appl. No.: 630,354

[52] U.S. Cl. ..... 165/61; 165/65; 62/80; 62/275

[51] Int. Cl.[2] ..... F25B 29/00

[58] Field of Search ..... 165/61, 65, 30; 62/80, 62/275

[56] References Cited

UNITED STATES PATENTS

| | | | |
|---|---|---|---|
| 2,465,107 | 3/1949 | Mascioli et al. | 62/238 |
| 2,758,452 | 8/1956 | Walz | 62/127 |
| 3,638,717 | 2/1972 | Harbour et al. | 165/30 |

*Primary Examiner*—Edgar W. Geoghegan
*Attorney, Agent, or Firm*—Edward P. Barthel

[57] ABSTRACT

A food receptacle for a refrigerator freezer compartment for fast-thawing and fast freezing food by the use of a concavo-convex heat energy reflective damper pivotally mounted in an air passage of the receptacle which communicates with an opening in the refrigerated air duct of the compartment. A high energy radiating lamp is located on the pivotal axis of the damper such that a manual control pivots the damper to a first evaporator defrost position closing the passage with the damper operative to direct heat energy from the lamp via reflective surfaces in the duct to the refrigerator cooling coil. The damper upon being pivoted to a second position, opens the passage and cooperates with the duct reflective surfaces to circulate below freezing air through the receptacle to fast freeze food therein. The damper, upon being pivoted to a third position, closes the passage and reflects heat energy from the lamp into the receptacle to fast-thaw food therein.

4 Claims, 8 Drawing Figures

REFRIGERATOR FOOD CONDITIONING APPLIANCE

This invention relates to refrigerator apparatus and more particularly to a food conditioning appliance adapted to be incorporated in the freezer compartment of a refrigerator enabling food to be rapidly frozen or thawed by means of a common heat source operative during a defrost cycle to supply heat to the cooling coils.

It is an object of this invention to provide a food fast thawing and fast freezing appliance for use with a domestic refrigerator that increases the utility and convenience thereof.

It is another object of this invention to provide a food conditioning appliance for use within the freezer compartment of a side-by-side refrigerator in which the circulation of freezer air from the freezer duct through a passageway in the appliance is controlled by a reflective rotatable damper, wherein upon rotating the damper about the axis of a high intensity defrost lamp heat energy is radiated into the appliance to fast-thaw food therein.

It is still another object of this invention to provide an economical improved refrigerator freezer wherein a heat lamp for a food conditioning appliance cooperates with a reflective damper to aid in the automatic defrosting of the refrigerator; and wherein the heat reflective damper may be selectively rotated to circulate freezer air through the appliance to fast-freeze food therein.

It is still another object of the invention to provide a domestic refrigerator with an insulated food storage receptacle disposed in the refrigerator freezer compartment such that a concavo-convex heat energy reflective damper member is pivotally mounted in an air passage in the receptacle, which passage communicates with an opening in the freezer air duct whereby a heat lamp disposed along the pivotal axis of the damper in concentric arrangement in front of the damper's concave reflective surface is operative, via reflective surfaces in the duct, to direct heat energy to the evaporator cooling coils in the duct during the defrost cycle of the refrigerator.

Further objects and advantages of the present invention will be apparent from the following description, reference being had to the accompanying drawings wherein a preferred form of the present invention is clearly shown.

Figure 1:
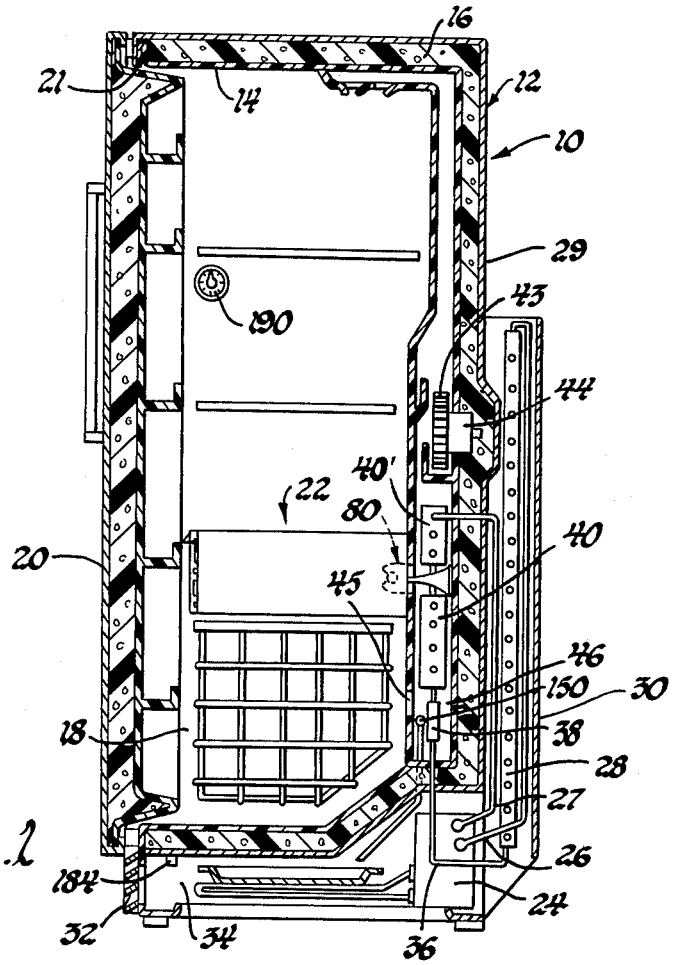
FIG. 1 is a vertical cross-sectional view through the freezing compartment of a side-by-side refrigerator-freezer, showing the location of the food conditioning compartment.

Referring to the drawings, a domestic upright refrigerator-freezer cabinet incorporating my invention is shown in FIG. 1 and indicated by reference numeral 10. It includes an outer metal shell 12 of general rectangular shape enclosing a plastic liner 14. Thermal insulation 16 is foamed in place between the outer shell and liner to reduce the flow of heat into freezing compartment 18. A door 20 is hinged to cabinet 10 in the conventional manner to close front access opening 21 to the freezing compartment 18 and to a food conditioning appliance generally indicated at 22, removably supported therein as by being slidably received on a horizontal cantilevered wire shelf such as shown in U.S. Pat. No. 3,877,767.

To provide the necessary refrigeration to maintain the freezing compartment 18 in the 0° F. temperature range, the cabinet 10 is provided with a conventional motor-compressor 24 adapted to pressurize refrigerant and deliver it through discharge line 26 to a condenser 28 positioned in a vertically extending plane adjacent the cabinet back wall 29 and enclosed duct 30, which permits room air entering via inlet grille 32 at the bottom of the cabinet 10, to flow through the machine compartment 34 and thence upward through the duct 30 to cool condenser 28. Liquified refrigerant leaves the bottom of condenser 28 and flows through line 36 to flow restrictor 38, where its pressure is dropped, permitting it to vaporize in evaporator 40, shown positioned in a vertically disposed manner adjacent the lower portion, by the evaporator absorbing heat from cabinet air being forced to flow over the evaporator by fan means in the form of blower wheel 43 driven by electric motor 44. As shown in FIG. 1, operation of the blower motor 44 causes air to be drawn from compartment 18, through air inlet 45 into the lower duct 46 and over the lower part of evaporator 40 located therein.

Figure 2:
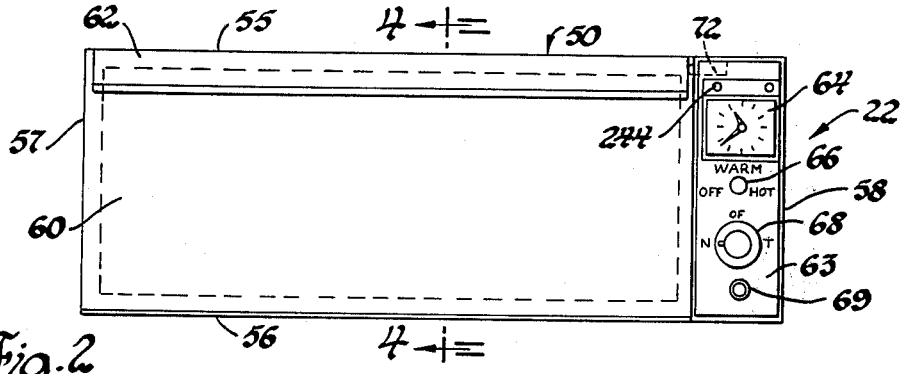
FIG. 2 is a front elevational view of the food conditioning compartment showing its access door and control panel.
Figure 3:
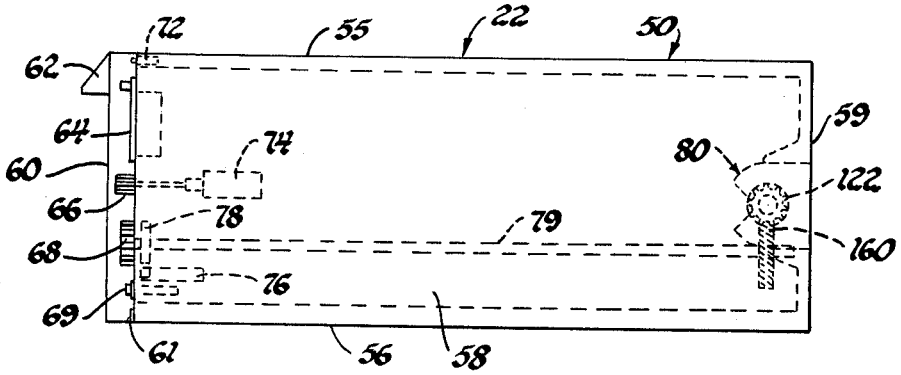
FIG. 3 is a side elevational view of the food conditioning compartment with certain control elements shown in dashed lines.
Figure 5:
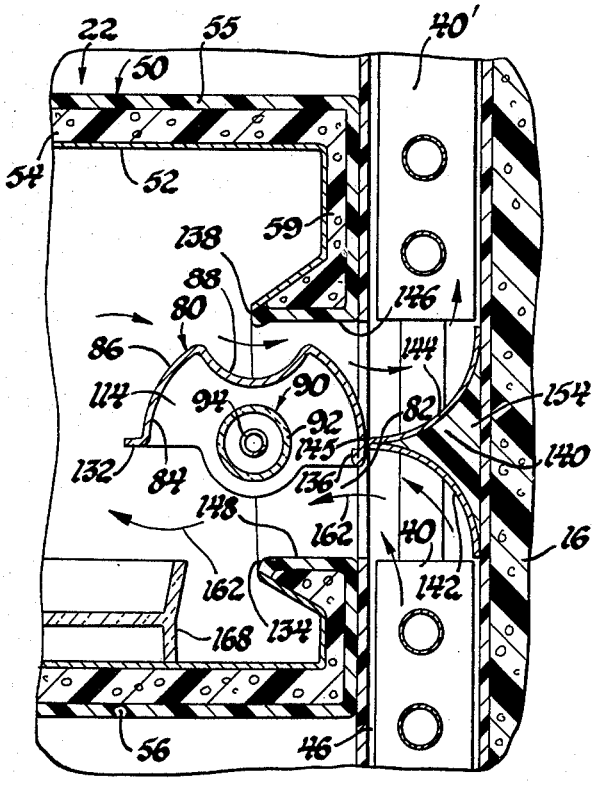
FIG. 5 is a view similar to FIG. 4, with the air and heat director rotated to its "Quick Freeze" position.

The removable food conditioning appliance 22 is shown in FIGS. 2 and 3 removed from refrigerator-freezer 10 for clarity. As best seen in FIG. 5, the appliance 22 includes a rectangular or box-shaped housing 50, preferably molded from plastic material and a cooperating inner metal liner 52, between which is provided suitable heat insulation material 54. The housing 50 is defined by a top and bottom wall 55, 56 respectively, which are connected on three sides by end walls 57, 58 and 59 to define a section having a front access open end closed by access door 60. The door 60, which is preferably a drop door connected to outer housing 50 by hinge 61, provides access to the interior thereof and includes a handle 62.

With reference to FIG. 2, control panel 63 is provided at one side of the food conditioning appliance 22, adjacent wall 58 and mounts a settable time clock 64, adjustable thermostat knob 66, operation mode selector knob 68 and an indicator lamp 69. Mounted directly behind the control panel 63 is a door switch 72, a thermostat 74 operated by knob 66, a mode selector switch 76 operated by cam means 78 fastened to longitudinally extending operating shaft 79 suitably journaled in the control panel 63 and rear wall 59 for rotation by mode selector knob 68 suitably keyed on the forward end thereof. The functioning of the controls will be described hereinafter.

Figure 4:
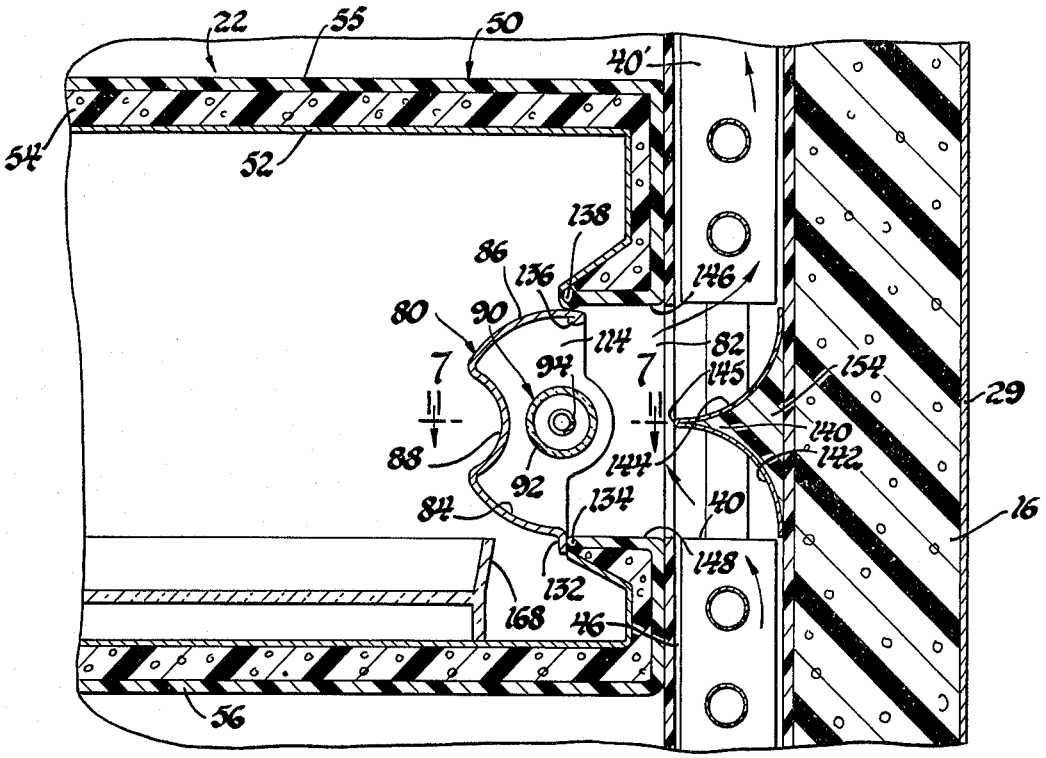
FIG. 4 is a partial vertical section taken along line 4—4 of FIG. 2 showing an air and heat director in its "Normal and Defrost" position.
Figure 6:
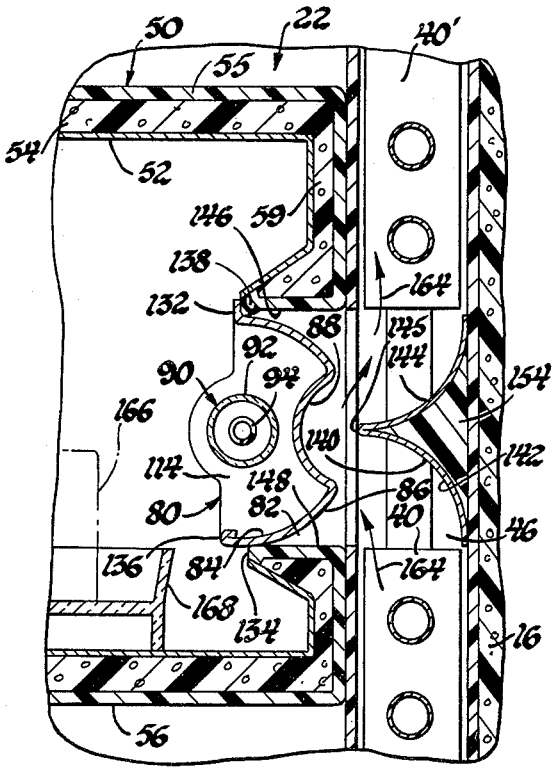
FIG. 6 is similar to FIG. 4, with the air and heat director rotated to its "Fast Thaw and Reheat" position.
Figure 7:
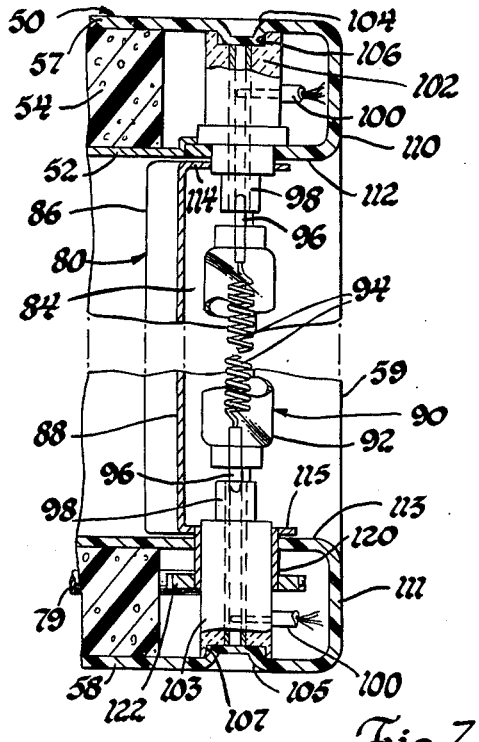
FIG. 7 is a fragmentary horizontal section taken on line 7—7 of FIG. 4.

As seen in FIGS. 4–6, a generally semi-cylindrical air and heat director or damper, generally indicated at 80, is mounted for rotational movement in a longitudinally extending passage or opening 82 located in the rear wall 59 of the housing 50. The director 80 is constructed of a good infrared reflecting material, preferably aluminum, having a highly polished and anodized inner surface 84. The director includes as part of its composite shape, a peripherally outer concave reflector section 86 that extends inwardly and a convex bridging reflector section 88, that cooperates with the adjacent concave reflector section 86 of the director to reflect heat from a heating element or lamp generally indicated at 90. The conventional lamp 90 has an outer transparent glass tube 92, preferably made of quartze, with a tungsten filament 94 extending substantially the lamp length as shown, for example, in applicant's patent application Ser. No. 420,366, filed Nov. 30, 1973, now U.S. Pat. No. 3,915,180 the disclosure of which is incorporated by reference herein.

Each end of the filament terminates in a metal terminal 96 shaped to be received in lamp sockets 98. To provide electric power to the lamp 90 a conductor 100, extending from a power source, terminates in terminal blocks 102 and 103. The terminal blocks are cylindrical and preferably made of dense porcelain having good heat conducting and electrical insulating properties. Each of the housing side walls 57 and 58 are inwardly deformed to provide bossed hubs 104 and 105 respectively, for mating reception in end circular terminal recesses 106 and 107. The housing rear wall portions 110 and 111 have return flanges 112 and 113 suitably apertured to receive the inner ends of the terminal blocks 102 and 103 therethrough such that their inner ends provide trunnion members upon which the director 80 is supported for pivotal movement about the principal axis of the lamp 90. The side wall 114 of the director 80 is suitably apertured for receiving the block 102 while the director side wall 115 is secured to the inner end of a tubular gear bearing 120 having an integral driven screw gear 122 which meshes with a driving screw gear 160. It will be noted that driving shaft 79 is at right angles to the axis of gear 122 requiring the teeth of both screw gears to be at an angle of 45°.

As previously mentioned, air passing over the lower part of evaporator 40, reaches the air and heat director 80, where its further path is determined by the position of the air and heat director 80. FIG. 4 shows the air and heat director 80 in a "Normal and Defrost" position, as determined by the position of mode selector knob 68 and the related position of cam 78 and associated mode selector switch 76. In the position of FIG. 4 the deflector radial strip flange or lip 132 contacts the lower edge 134 of passage 82 and upper deflector edge 136 is in substantially sealed contact with passage upper edge 138. Thus, as seen by the solid arrows, all of the air from the lower portion of evaporator 40 flows between a fixed double concave reflector 140 and the air and heat director 80, thence over the upper portion 40' of the evaporator to the motor-blower 43. As a result, food placed in the food conditioning appliance 22 will normally be cooled by the flow of 0° F. zone air flowing around the exterior of housing 50. For food items of long term storage, the effect of insulation 54 on the eventual interior temperature of the appliance is negligible.

It will be noted in FIG. 4 that during a timer initiated defrost cycle, in which the heater element 94 is energized, a portion of the electromagnetic energy generated by the element 94 is radiated directly through the passage 82 while another portion of the energy, striking the concave reflecting inner surface 84 of director 80, is reflected or re-radiated through passage 82. Upon entering the lower duct 46, the total energy is directed toward lower and upper spaced interconnected evaporator sections 40 and 40' by direct radiation from heater element 94; or by reflection or re-radiation from the combined air baffle and heat reflector 140 in the form of two concave faces 142, 144 of parabolic character that are joined by a central horizontally extending cuspidal edge or ridge portion 145. Also, the energy may be directed by reflective means such as aluminum foil covering the parallel, horizontally disposed upper 146 and lower 148 surfaces of housing passage 82 and refrigerator duct 46. Such electromagnetic energy, coupled with that from a defrost heater element 150, shown in FIG. 1 located below the lower evaporator portion 40 in duct 46, is sufficient to properly defrost the evaporator cooling coils under control of defrost timer 184 positioned in machine compartment 34. If desired, thermal insulation 154 may be applied to the rear surface of air baffle-reflector 140. It will be noted, however, that if the reflective surfaces 142, 144 are formed of highly polished aluminum or stainless steel, the efficiency of re-radiation is of a level that insulation is not required.

Referring now to FIG. 5, the air and heat damper or director member 80 is shown rotated from its first position in a clockwise direction through an angle of about 90° to a second position wherein the appliance is in its "Quick Freeze" mode, as determined by the position of the mode selector knob 68 and the related position of cam 78 and switch 76. As shown in FIG. 3, director 80 is moved to this position through mode selector knob 68 and shaft 79 rotating right angle drive screw gear 160, which in turn rotates cooperating driven screw gear 122 fastened to the end of the director bearing 120. In the "quick freeze" mode it will be seen that all the refrigerated air (arrows 162) from the lower portion of evaporator 40 is forced to pass through the interior of the food conditioning appliance 22 before passing over the upper portion 40' of the evaporator and entering the motor-blower wheel 43. Consequently any foods placed in the appliance 22 will be subjected to a temperature only slightly less than the maximum cooling capacity of evaporator 40 and the food will accordingly be rapidly chilled or quick frozen, depending upon the length of time director 80 remains in the position of FIG. 5 allowing the passage of air through opening 82. As will be explained later, the defrost heating element 150 cannot be energized in this position.

FIG. 6 shows the air and heat director 80 rotated in a first clockwise direction an additional 90° to its "Quick Defrost and Reheat" position, as determined by the selected position of mode selector knob 68 and the related position of cam 78 and associated mode selector switch 74, as well as the rotation of shaft 79 and screw gears 122 and 160 wherein stop lip 132 engages edge 138. As will be seen, the position of the director 80 prevents any air (arrows 164) from the lower evaporator portion 40 from entering the food conditioning appliance 22 and directs the air over the evaporator upper portion 40' to motor-blower 43. In this position, however, all the electromagnetic energy produced by lamp heater element 94 is directed to the interior of compartment liner 52, either by direct radiation or by reflected or re-radiation. Since the liner 52 is either of aluminum or stainless steel and has highly polished surfaces, almost all other electromagnetic energy striking the liner surfaces is reflected or re-radiated in a continuous, random manner until the energy eventually strikes the food load 166, which may be placed in a glass or quartz tray 168, essentially transparent to such electromagnetic energy. The amount of electromagnetic energy directed into the food load 166 is determined by the setting of the clock 64 and thermostat 74, as will be described later.

Figure 8:
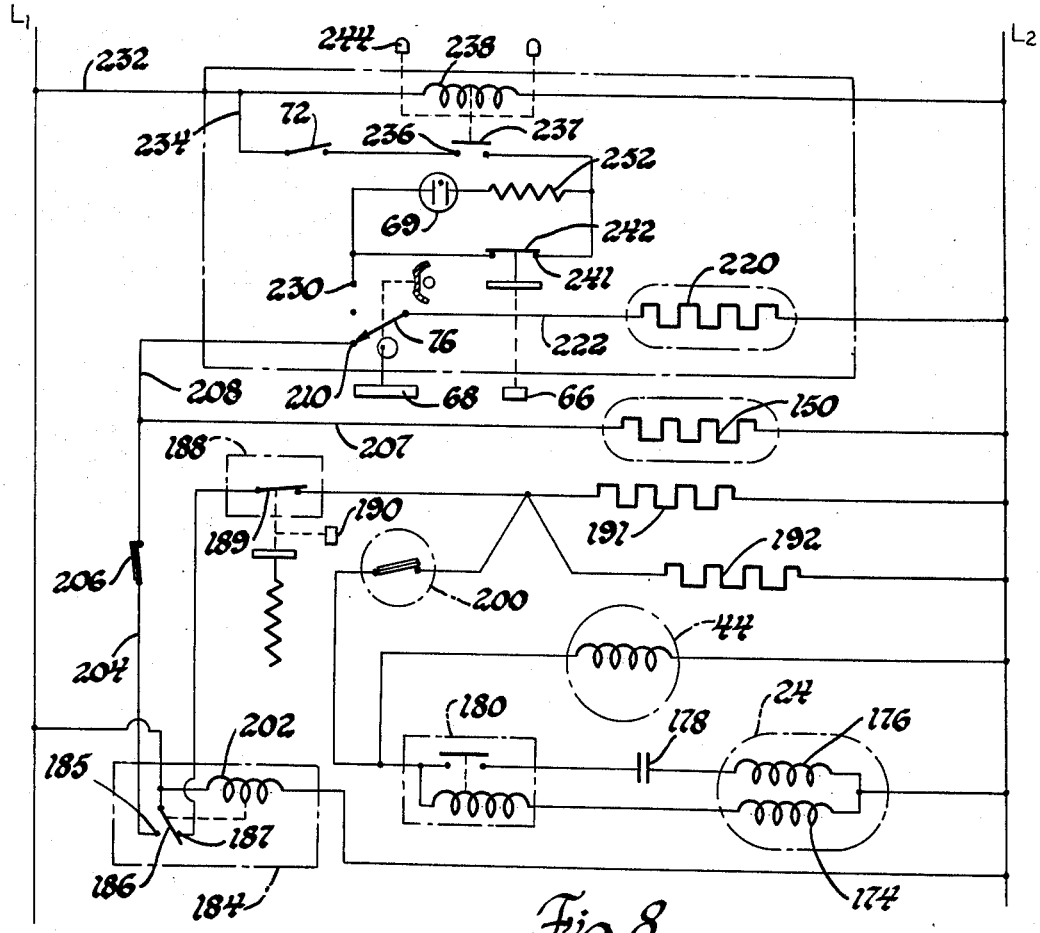
FIG. 8 is a schematic control circuit for the invention.

Turning now to FIG. 8, there is shown a schematic wiring diagram of the side-by-side refrigerator-freezer 10 and its associated food conditioning appliance 22. As shown, the motor compressor unit 24 has a run winding 174 and a start winding 176 with a starting capacitor 178 in series. A conventional current operated start relay 180 momentarily energizes the start winding circuit and then deenergizes the circuit when the motor comes up to rated speed and the main winding 174 current falls off. The motor compressor unit 24 is normally energized from line $L_1$ through defrost timer 184 when the timer switch blade 186 is closed on contact 187. This feeds electrical power to cold control thermostat 188 having a movable contact 189 adjustable by cold control knob 190 (FIG. 1). When the cold control contact 189 is closed, the mullion heaters 191 and 192 used to prevent sweating on several exterior surfaces of the refrigerator freezer 10, are energized along with the motor start relay 180 via the motor protector 200.

Operation of the defrost timer 184 is via clock-like mechanism operated by a motor having a motor winding 202. At specific time intervals, such as at every eight hours, the defrost timer mechanism moves movable contact blade 186 from its refrigeration contact 187 to its defrost contact 185. This deenergizes the evaporator motor-blower unit 44, the motor-compressor unit 24 and mullion heaters 191 and 192 and energizes line 204 connected to defrost limiter thermostat 206 and thence by line 207 to defrost heater 150; while line 208 energizes to the Normal Defrost terminal position 210 of mode selector switch 76. It will be noted that when the mode selector knob 68 is in its Normal and Defrost position the defrost timer 184 allows the defrost heater 220 to be energized via line 222, while if the mode selector knob 68 is set at its Quick Freeze position the heater 220 cannot be energized.

Upon the mode selector knob 68 being moved to its Fast Thaw and Reheat position, the switch 76 closes on terminal 230. In this position, heater element 220 is energized from line $L_1$, through conductors 232 and 234, appliance door switch 72 (when the door 60 is fully closed), clock operated contacts 236 and 237 (when closed by the clock mechanism 238), contacts 241 and 242 of thermostat 74 (when closed), terminal 230 and mode selector switch 76, through the heater element 220 to line $L_2$. As shown in FIGS. 2 and 8, the clock mechanism 238 is provided with knob 244 to set the time at which contacts 236 and 237 are opened. If desired, clock mechanism 238 may be designed with the feature of permitting manually closing contacts 236, 237 so as to enable food to be thawed or reheated under direct manual control. The thermostat 74 provides a means for regulating the amount of heat applied to the interior of appliance 22 and its setting can be altered by means of knob 66. While the heat sensing function of thermostat 74 may be accomplished either by a bimetal or by a volatile fluid charged tube in contact with one of the walls of the appliance liner 52, a sensor in contact with tray 168 or food load 166 is also contemplated.

As will be noted in FIG. 8, the neon indicator lamp 69 has a series resistor 252 to limit the current flow therethrough and the lamp 69 will be energized solely in the Quick Thaw and Reheat mode setting upon the thermostat contacts 241 and 242 opening to provide a signal to the operator that the Quick Thaw or Reheat operation has been completed. If desired, the indicator lamp 69 may be placed exterior of the refrigerator-freezer 10, such as, for example, beneath the door on the machinery compartment air inlet 32. It will be appreciated that an audible signal, such as a buzzer may be substituted for lamp 69 and resistor 252, if desired.

Thus it can be seen that a novel, versatile and useful food conditioning apparatus has been invented that can be readily incorporated into a refrigerator-freezer with a minimum of cost and which can efficiently utilize many components of a conventional refrigerator-freezer. Also, when not in use, the food conditioning apparatus does not detract significantly from the normal food freezing and storing capacity of the refrigerator-freezer.

While the embodiment of this invention as disclosed in the drawings is one of the most useful forms, it is to be understood that other modifications and arrangements are possible within the scope of the following claims.

I claim:

1. In a refrigerator, a cabinet having an insulated food storage compartment therein for storage of frozen foods, an evaporator cooling coil within said compartment having a vertically disposed air flue duct, an evaporator cooling coil within said duct, fan means in said air duct for forcibly circulating air in heat exchange transfer relation with said evaporator prior to the air being exited into said freezer compartment, an insulated food storage receptacle disposed in said compartment in a position such that said duct has an air outlet in communication with an air inlet in said receptacle, a reflective damper member pivotally mounted in said receptacle air inlet for controlling the flow of refrigerated air therethrough, infrared lamp means mounted in front of the reflective surface of said damper, selectable damper control means pivoting said damper member to a plurality of positions including a normal refrigerating position and a fast thawing position; said damper member operative in said refrigerating position closing said inlet and directing infrared radiation heat energy from said lamp means by reflective means in said duct onto said cooling coil during a defrost cycle, said damper member operative in said fast thaw position closing said inlet and directing infrared radiation heat energy from said lamp means into said receptacle to fast thaw food items placed therein.

2. In a refrigerator, a cabinet having an insulated food storage compartment therein for storage of frozen foods, an evaporator cooling coil within said compartment having a vertically disposed air flue duct, an evaporator cooling coil within said duct, fan means in said air duct for forcibly circulating air in heat exchange transfer relation with said evaporator prior to the air being exited into said freezer compartment, an insulated food storage receptacle disposed in said compartment in a position such that said duct has an air outlet in communication with an air inlet in said receptacle, a reflective damper member pivotally mounted in said receptable air inlet for controlling the flow of refrigerated air therethrough, infrared lamp means mounted in front of the reflective surface of said damper, selectable damper control means pivoting said damper member to a first normal refrigerator position, a second fast freezing position, and a third fast thawing position, said damper member operative in said first position closing said inlet and directing infrared radiation heat energy from said lamp means by reflective wall means in said duct onto said cooling coil during a defrost cycle of said refrigerator, said damper member operative in said second fast freezing position opening said inlet to permit the entry of refrigerated air from said duct into said receptacle for fast freezing of food therein, and said damper member operative in said third position closing said inlet and directing infrared radiation heat energy from said lamp means into said receptacle to fast thaw food items placed therein.

3. In a refrigerator, a cabinet having an insulated food storage compartment therein for storage of frozen foods, an evaporator cooling coil within said compartment adjacent the rear wall of said compartment, a wall spaced outwardly from said rear wall forming an air flue duct, fan means in said duct for forcibly circulating air in heat exchange transfer relation with said cooling coil prior to the air being exited into said freezer compartment, an insulated food storage receptacle disposed in said compartment in a position such that said air duct has an air outlet in communication with an air inlet in said receptacle, a concavo-convex reflective damper member pivotally mounted in said receptacle air inlet for controlling the flow of refrigerated air therethrough, infrared lamp means mounted in front of the concave reflective surface of said damper, selectable damper control means pivoting said damper member to a first normal refrigerator position, a second fast freezing position, and a third fast thawing position; said damper member operative in said first position closing said inlet and directing infrared radiation heat energy from said lamp means by reflective wall means in said duct onto said cooling coil during a defrost cycle, said damper member operative in said second position opening said inlet to permit the entry of refrigerated air from said duct into said receptacle for fast freezing of food therein, said damper member operative in said third position closing said inlet and directing infrared radiation heat energy from said lamp means into said receptacle to fast thaw food items placed therein.

4. In a refrigerator, a cabinet having an insulated food storage compartment therein for storage of frozen foods, an evaporator cooling coil within said compartment adjacent the rear wall of said compartment, a wall spaced outwardly from said rear wall forming an air flue duct, fan means in said duct for forcibly circulating air in heat exchange transfer relation with said cooling coil prior to the air being exited into said freezer compartment, an insulated food storage receptacle disposed in said compartment in a position such that said air duct has an opening in communication with a horizontally disposed air passage in the rear wall of said receptacle, a concavo-convex damper member defining a concave reflective surface interrupted by an intermediate concave reflector section pivotally mounted in said receptacle air passage for controlling the flow of refrigerated air therethrough, a high energy radiant tubular lamp mounted in front of the concave reflective surface of said damper, said lamp disposed in longitudinal alignment with the pivotal axis of said reflective damper, and mounted in concentric arrangement in front of said concave reflective surface; selectable damper control means pivoting said damper member to a first normal refrigerator position, a second fast freezing position, and a third fast thawing position; said damper member reflective surface operative in said first position closing said inlet passage and directing heat energy from said lamp to concave-shaped reflective air baffle surfaces in said duct for reflecting heat energy upwardly and downwardly to said cooling coil during a defrost cycle, said damper member operative upon being rotated approximately ninety degrees to said second position opening said inlet permitting the entry of refrigerated air via said passage from said duct into said receptacle for fast freezing of food therein, and said intermediate concave reflector section permitting the return of refrigerated air via said passage to said duct for delivery to said refrigerator food storage compartment; said damper member operative upon being rotated an additional ninety degrees to said third position closing said inlet wherein its reflective surface directs heat energy from said lamp into said receptacle to fast thaw food items placed therein.

* * * * *